US010410771B2

(12) United States Patent
Matsumoto

(10) Patent No.: US 10,410,771 B2
(45) Date of Patent: Sep. 10, 2019

(54) CHIP RESISTOR AND METHOD FOR PRODUCING CHIP RESISTOR

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/763,574

(22) PCT Filed: Sep. 20, 2016

(86) PCT No.: PCT/JP2016/077699

§ 371 (c)(1),
(2) Date: Mar. 27, 2018

(87) PCT Pub. No.: WO2017/057096

PCT Pub. Date: Apr. 6, 2017

(65) Prior Publication Data

US 2018/0277286 A1 Sep. 27, 2018

(30) Foreign Application Priority Data

Sep. 28, 2015 (JP) ..... 2015-189765

(51) Int. Cl.
*H01C 1/034* (2006.01)
*H01C 1/012* (2006.01)
(Continued)

(52) U.S. Cl.
CPC ..... *H01C 1/034* (2013.01); *H01C 1/012* (2013.01); *H01C 1/02* (2013.01); *H01C 1/148* (2013.01); *H01C 17/006* (2013.01); *H01C 17/02* (2013.01)

(58) Field of Classification Search
CPC ..... H01C 17/02; H01C 1/148; H01C 1/142; H01C 1/02; H01C 1/032; H01C 1/012
See application file for complete search history.

(56) References Cited

U.S. PATENT DOCUMENTS

2002/0014949 A1* 2/2002 Tanaka ..... H01C 1/02 338/313
2005/0035844 A1* 2/2005 Tsukada ..... H01C 1/148 338/309

FOREIGN PATENT DOCUMENTS

JP 10-275702 A 10/1998
JP 2003-264101 A 9/2003
(Continued)

OTHER PUBLICATIONS

Hanaoka et al., JP 2003-264101 (Year: 2003).*
(Continued)

*Primary Examiner* — Kyung S Lee
(74) *Attorney, Agent, or Firm* — Crowell & Moring LLP

(57) ABSTRACT

Provided is a chip resistor including: a rectangular parallelepiped insulating substrate 1 which is made of ceramics; a pair of front electrodes 2 which are provided on lengthwise opposite end portions in a front surface of the insulating substrate 1; a resistive element 3 which is provided between and connected to the two front electrodes 2; an insulating protective layer 4 which covers the whole of the front surface of the insulating substrate 1 including the resistive element 3 and the two front electrodes 2; and a pair of cap-shaped end-surface electrodes 5 which are provided on the lengthwise opposite end portions of the insulating substrate 1 to be connected to the front electrodes 2; wherein: the protective layer 4 is formed out of a semi-transparent resin material which is similar in color to the insulating substrate 1.

2 Claims, 4 Drawing Sheets

(51) Int. Cl.

| | |
|---|---|
| ***H01C 1/02*** | (2006.01) |
| ***H01C 17/02*** | (2006.01) |
| ***H01C 1/148*** | (2006.01) |
| ***H01C 17/00*** | (2006.01) |

(56) References Cited

FOREIGN PATENT DOCUMENTS

| | | | |
|---|---|---|---|
| JP | 2004-158600 | A | 6/2004 |
| JP | 2007-173282 | A | 7/2007 |

OTHER PUBLICATIONS

International Search Report (PCT/ISA/210) issued in PCT Application No. PCT/JP2016/077699 dated Nov. 22, 2016 with English-language translation (three (3) pages).
Japanese-language Written Opinion (PCT/ISA/237) issued in PCT Application No. PCT/JP2016/077699 dated Nov. 22, 2016 (three (3) pages).

* cited by examiner

CHIP RESISTOR AND METHOD FOR PRODUCING CHIP RESISTOR

TECHNICAL FIELD

The present invention relates to a chip resistor which is surface-mounted on a circuit board by soldering, and a method for producing such a chip resistor.

BACKGROUND ART

Generally, a chip resistor includes a rectangular parallelepiped insulating substrate, a pair of front electrodes, a resistive element, an insulating protective layer, a pair of back electrodes, a pair of end-surface electrodes, and a pair of external electrodes. The insulating substrate is made of ceramics. The pair of front electrodes are disposed on a front surface of the insulating substrate so as to be opposite to each other with interposition of a predetermined interval therebetween. The resistive element is provided on the front surface of the insulating substrate so as to be connected to the pair of front electrodes. The protective layer is provided so as to cover the resistive element. The pair of back electrodes are disposed on a back surface of the insulating substrate so as to be opposite to each other with interposition of a predetermined interval therebetween. The pair of end-surface electrodes are provided on opposite end surfaces of the insulating substrate so as to establish electrical continuity between the front electrodes and the back electrodes respectively. The pair of external electrodes are formed by plating treatment on outer surfaces of the end-surface electrodes.

Usually, such a chip resistor is produced in the following manner. That is, electrodes, resistive elements, a protective layer, etc. corresponding to a large number of chip resistors are collectively formed on a large-sized substrate. Then, the large-sized substrate is divided into grids so as to obtain individual chip elements. As such a division method, there has been widely known a method in which division grooves each formed into a V-shape in section are provided in a grid pattern in the large-sized substrate in advance, and the large-sized substrate is broken along these division grooves. However, as the chip resistor is miniaturized in recent years, there has been used another method in which the large-sized substrate is cut by dicing instead of providing the division grooves.

In such a division method using dicing, the protective layer has to be provided before dicing is performed. For this reason, when the front electrodes and the resistive elements are covered with the protective layer, dicing positions become unable to recognize. In the worst case, a problem of cutting the resistive elements by dicing may arise.

In order to solve such a problem, the following method has been proposed, as disclosed in PTL 1. That is, a plurality of recognition marks are formed in advance in a dummy region of a peripheral portion of a large-sized substrate and simultaneously with resistive elements, and a fixation tape is pasted on an inner region than these recognition marks. Then, dicing is performed using the recognition marks exposed in the outside of the fixation tape, as reference positions. In this case, it is impossible to confirm positions of electrodes or the resistive elements from above the fixation tape but the recognition marks are formed simultaneously with the resistive elements and in the dummy region exposed in the circumference of the fixation tape. Therefore, when dicing positions are determined with reference to the recognition marks, it is possible to prevent the resistive elements from being cut by mistake.

CITATION LIST

Patent Literature

PTL 1: JP-A-2007-173282

SUMMARY OF INVENTION

Technical Problem

According to the background-art technique disclosed in PTL 1, when the fixation tape is pasted on a front surface side of the large-sized substrate, it is however necessary to arrange the periphery of the fixation tape not to overlap with the recognition marks in the dummy region of the large-sized substrate. To this end, the dummy region has to be set widely in consideration of a positional displacement when the fixation tape is pasted. Therefore, there is a problem that a percentage of the large-sized substrate occupied by the dummy region (a portion which cannot be products but has to be thrown away) may increase accordingly. In addition, the recognition marks have to be formed in positions as far as possible from chip formation regions which will be products. As the recognition marks are farther from the chip formation regions, an error caused by stretch etc. of a printing mask may be however generated more easily. Therefore, there is a fear that the dicing positions determined with reference to the recognition marks may be displaced from normal positions.

The present invention has been accomplished in consideration of such actual circumstances inherent in the background-art technique. A first object of the present invention is to provide a chip resistor which can prevent dicing failure by a simple configuration. In addition, a second object of the present invention is to provide a method for producing such a chip resistor.

Solution to Problem

In order to attain the aforementioned first object, according to the present invention, there is provided a chip resistor configured to include: a rectangular parallelepiped insulating substrate which is made of ceramics; a pair of front electrodes which are provided on lengthwise opposite end portions in a front surface of the insulating substrate; a resistive element which is provided between and connected to the two front electrodes; an insulating protective layer which covers the whole of the front surface of the insulating substrate including the resistive element and the two front electrodes; and a pair of cap-shaped end-surface electrodes which are provided on the lengthwise opposite end portions of the insulating substrate to be connected to the front electrodes; wherein: the protective layer is made of a semi-transparent resin which is similar in color to the insulating substrate.

In the chip resistor configured thus, the protective layer covering the front electrodes and the resistive element is made of the semi-transparent resin which is similar in color to the insulating substrate. Accordingly, when a large-sized substrate is diced and divided into individual chip elements, positions of front electrodes and resistive elements are confirmed through a protective layer so that dicing positions can be determined accurately. Thus, dicing failure of cutting the resistive elements by mistake can be prevented. In addition, the cap-shaped end-surface electrodes are provided on the lengthwise opposite end portions of the insulating substrate. Thus, the chip resistor is suitable for bulk mounting with no directivity in terms of front, back, etc. When an image is taken and processed as to whether the chip resistor has been accurately mounted on lands of a circuit board or not, the image is always taken in the same color regardless of mounting posture of the chip resistor because one exposed surface of the protective layer and the remaining three ceramics surfaces of the insulating substrate are similar in color. Thus, the image can be processed easily and with high accuracy.

In the aforementioned configuration, it is preferable that the protective layer contains 2% to 25% white pigment in an epoxy-based resin. In this case, the ceramics of the insulating substrate and the protective layer can be set at the same whitish color while positions of the front electrodes and the resistive elements can be confirmed easily through the protective layer.

Moreover, in order to attain the aforementioned second object, according to the present invention, there is provided a method for producing a chip resistor, including the steps of: forming a pair of front electrodes on each of chip formation regions in a front surface of a large-sized substrate made of ceramics; forming resistive elements to be provided between and connected to the paired front electrodes with each other respectively; forming a protective layer on the whole of the chip formation regions in the front surface of the large-sized substrate to thereby cover the front electrodes and the resistive elements, the protective layer being made of a semi-transparent resin similar in color to the large-sized substrate; confirming positions of the front electrodes and the resistive elements through the protective layer to thereby determine dicing positions, and then cutting the large-sized substrate along primary division lines and secondary division lines based on the dicing positions by a dicing blade to thereby form individual chip elements, the primary division lines passing through central portions of the front electrodes and extending in a lengthwise direction, the secondary division lines intersecting the primary division lines perpendicularly; and applying an electrically conductive paste to areas ranging from cut surfaces of the chip elements along the primary division lines to portions of cut surfaces of the chip elements along the secondary division lines to thereby form end-surface electrodes.

In this manner, the front electrodes and the resistive elements corresponding to a large number of chip resistors are formed on the front surface of the large-sized substrate, and the front electrodes and the resistive elements are covered with the protective layer made of the semi-transparent resin similar in color to the large-sized substrate. Then, the positions of the front electrodes and the resistive elements are confirmed through the protective layer. Thus, the dicing positions can be determined accurately. Therefore, as long as the large-sized substrate is diced into grids based on the dicing positions, dicing failure of cutting the resistive elements by mistake can be prevented. In addition, the cap-shaped end-surface electrodes are formed on the lengthwise opposite end portions of the chip elements obtained thus by dicing. Thus, chip resistors suitable for bulk mounting with no directivity in terms of front, back, etc. are produced. When an image is taken and processed as to whether each of the chip resistors has been accurately mounted on lands of a circuit board or not, the image is always taken in the same color regardless of mounting posture of the chip resistor because one exposed surface of the protective layer and the remaining three ceramics surfaces of the insulating substrate are similar in color. Thus, the image can be processed easily and with high accuracy.

In the aforementioned producing method, when the large-sized substrate is irradiated with backlight from behind in order to confirm the positions of the front electrodes and the resistive elements through the protective layer, beams of the backlight are blocked by the front electrodes and the resistive elements. Accordingly, the positions of the front electrodes and the resistive elements can be confirmed easily and accurately from above the protective layer.

Advantageous Effects of Invention

According to the present invention, it is possible to realize a chip resistor which can prevent dicing failure of cutting a resistive element by mistake and which is suitable for bulk mounting.

DESCRIPTION OF EMBODIMENT

Figure 1:
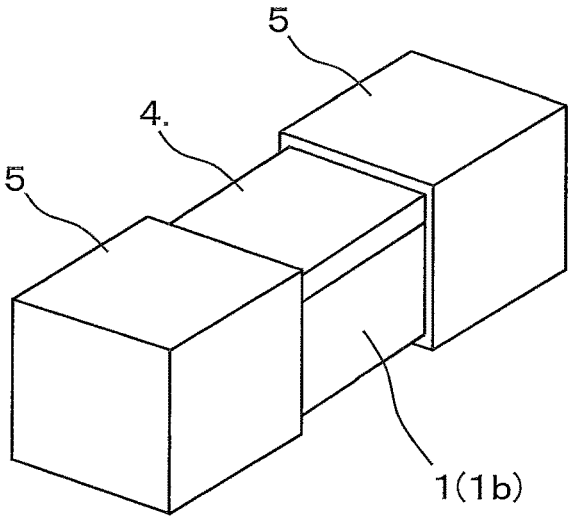
FIG. 1 A perspective view of a chip resistor according to an embodiment of the present invention.

A mode for carrying out the present invention will be described below with reference to the drawings. As shown in FIGS. 1 to 5, a chip resistor according to an embodiment of the present invention is mainly constituted by a rectangular parallelepiped insulating substrate 1, a pair of front electrodes 2, a rectangular resistive element 3, an insulating protective layer 4, and a pair of end-surface electrodes 5. The pair of front electrodes 2 are provided on lengthwise opposite end portions in a front surface of the insulating substrate 1. The resistive element 3 is provided so as to be connected to the front electrodes 2. The protective layer 4 covers the whole of the front surface of the insulating substrate 1 including the two front electrodes 2 and the resistive element 3. The pair of end-surface electrodes 5 are provided on the lengthwise opposite end portions of the insulating substrate 1.

The insulating substrate 1 is made of ceramics (Alumina 96%). A large-sized substrate which will be described later is diced along primary division grooves and secondary division grooves which extend lengthwise and widthwise. Thus, a large number of such insulating substrates 1 are obtained.

The pair of front electrodes 2 are obtained by screen-printing, drying and sintering an Ag-based paste. Each of the front electrodes 2 is formed into a rectangle or a square so as to be exposed from three end surfaces of the insulating substrate 1. The three end surfaces are continuous to one another in a U-shape.

The resistive element 3 is obtained by screen-printing, drying and sintering a resistive paste of ruthenium oxide or the like. Lengthwise opposite end portions of the resistive element 3 overlap with the front electrodes 2 respectively.

Incidentally, although not shown, a trimming groove is formed in the resistive element 3 in order to adjust a resistance value thereof.

Figure 3:
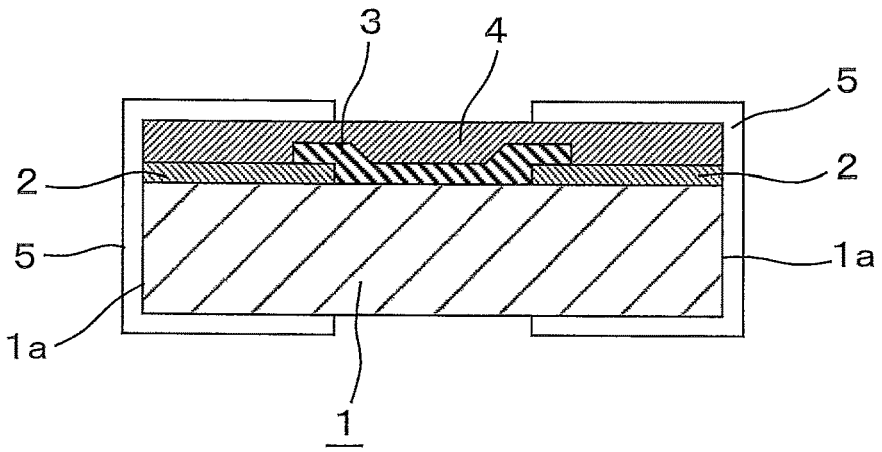
FIG. 3 A sectional view taken along a line III-III of FIG. 2.
Figure 4:
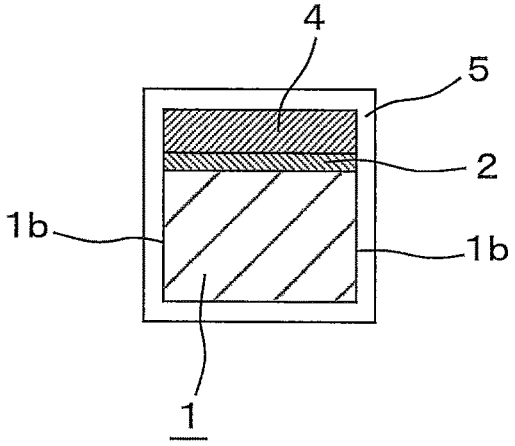
FIG. 4 A sectional view taken along a line IV-IV of FIG. 2.
Figure 5:
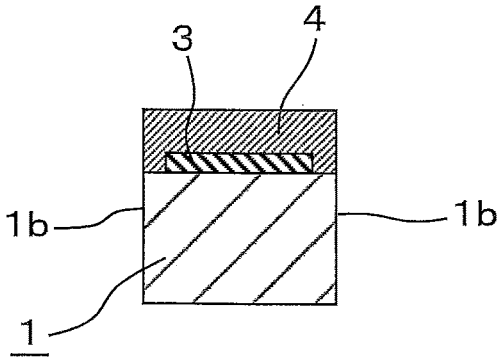
FIG. 5 A sectional view taken along a line V-V of FIG. 2

The protective layer 4 is an overcoat layer which is obtained by screen-printing and thermally curing an epoxy-based resin paste. Although not shown, a transparent undercoat layer is formed on a lower side of the protective layer 4 to cover the resistive element 3. Incidentally, the undercoat layer is obtained by screen-printing, drying and sintering a glass paste. The protective layer 4 is formed to cover the whole of the front surface of the insulating substrate 1 including the two front electrodes 2 and the resistive element 3. Three end surfaces including a left end of the front electrode 2 positioned on a left side in FIG. 3 are exposed from a space between the insulating substrate 1 and the protective layer 4. Three end surfaces including a right end of the front electrode 2 positioned on a right side in FIG. 3 are exposed from the space between the insulating substrate 1 and the protective layer 4.

The protective layer 4 is made of a semi-transparent resin similar in color to the ceramics which is the material of the insulating substrate 1. In the case of the embodiment, an epoxy resin added with white pigment (e.g. titanium oxide) is used. Here, a content of the white pigment relative to the epoxy resin is preferably set in a range of 2% to 25% in accordance with a film thickness of the protective layer 4. For example, in order to form the protective layer 4 having a film thickness of about 10 μm, the epoxy resin containing about 5% titanium oxide (having a particle size of about 0.25 μm) is preferably used. The reason is as follows. That is, when the content of the white pigment is less than 2%, the protective layer 4 is too high in degree of transparency to be semi-transparent. On the contrary, when the content of the white pigment exceeds 25%, the protective layer 4 becomes cloudy to be impaired in transparency. Alternatively, a particle size of color pigment used for coloring may be reduced so that the protective layer 4 can be increased in the degree of transparency so as to be semi-transparent. For example, when titanium oxide having a particle size of 0.10 μm or less is used as the color pigment, the protective layer 4 can be increased in the degree of transparency so as to be semi-transparent even if the content of the titanium oxide exceeds 25%.

The pair of end-surface electrodes 5 are obtained by dip-coating and thermally curing an Ag paste or a Cu paste. These end-surface electrodes 5 are formed into a cap shape so as to cover opposite end surfaces 1*a* of the insulating substrate 1, an upper surface of the protective layer 4 and a lower surface and opposite side surfaces 1*b* of the insulating substrate 1. Thus, the end-surface electrode 5 positioned on the left side in FIG. 3 is connected to the three end surfaces of the left front electrode 2 exposed from the space between the insulating substrate 1 and the protective layer 4, and the end-surface electrode 5 positioned on the right side in FIG. 3 is connected to the three end surfaces of the right front electrode 2 exposed from the space between the insulating substrate 1 and the protective layer 4. Incidentally, a chip element in which the end-surface electrodes 5 have not been formed yet is substantially shaped like a square cylinder as its external shape. The cap-shaped end-surface electrodes 5 are formed on lengthwise opposite end portions of the chip element having such a shape. That is, the insulating substrate 1 is shaped like a rectangular parallelepiped having a thickness shorter than a width. The protective layer 4 having a predetermined thickness is laminated so as to cover the whole of the front surface of the insulating substrate 1. Thus, the chip element shaped like the square cylinder having a thickness equal to a width is formed.

Although not shown, the pair of end-surface electrodes 5 are covered with external electrodes. Front surfaces of the end-surface electrodes 5 are electroplated with Ni, Sn, or the like. Thus, these external electrodes are formed.

Next, a method for producing the chip resistor configured as described above will be described with reference to FIGS. 6A-6F and FIGS. 7A-7E.

Figure 6A:
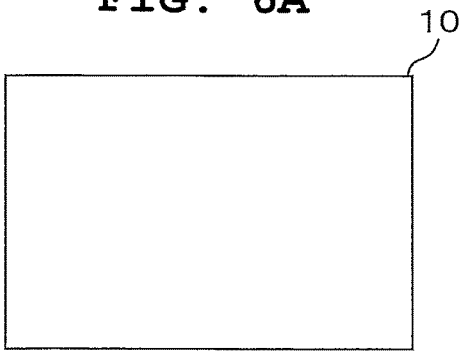
FIGS. 6A-6F Explanatory views showing producing steps of the chip resistor.
Figure 6D:
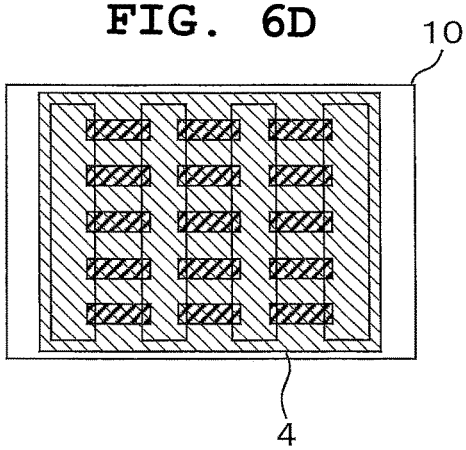
Figure 6B:
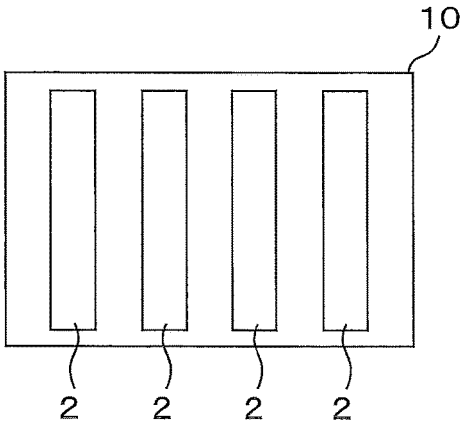
Figure 6E:
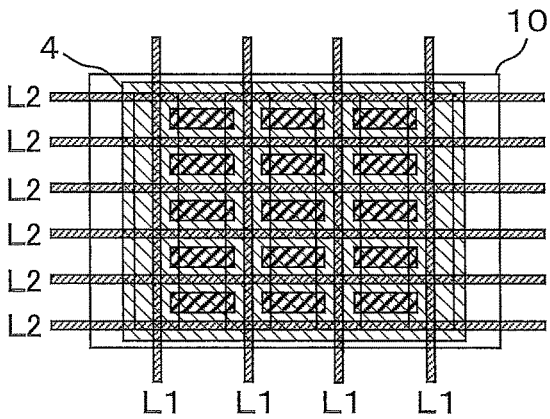
Figure 6C:
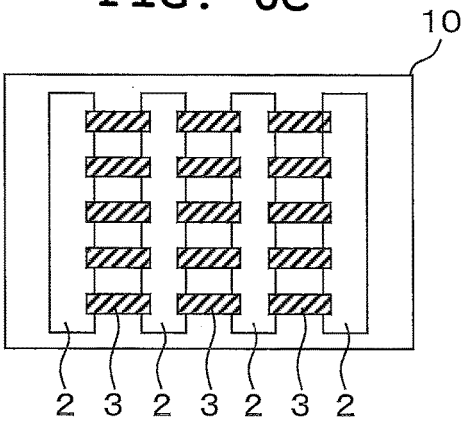
Figure 6F:
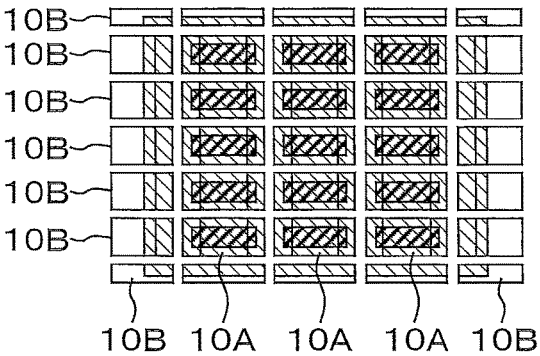
Figure 7A:
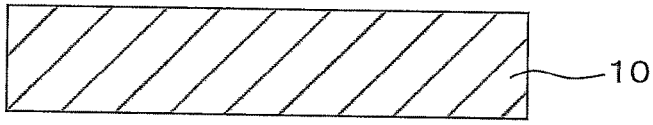
FIGS. 7A-7E Explanatory views showing the producing steps of the chip resistor.

First, as shown in FIG. 6(A) and FIG. 7(A), a large-sized substrate 10 which is made of ceramics and from which a large number of insulating substrates 1 can be obtained is prepared. Primary division grooves or secondary division grooves are not formed in the large-sized substrate 10. However, in a subsequent step shown in FIG. 6(E), the large-sized substrate 10 will be diced along primary division lines L1 and secondary division lines L2 extending lengthwise and widthwise, and each of grids partitioned by the two division lines L1 and L2 will serve as a chip formation region for one chip resistor. Incidentally, FIGS. 6A-6F show states in which the large-sized substrate 10 is viewed planarly. FIGS. 7A-7E show states in which the chip formation region for one chip resistor in FIGS. 6A-6F is viewed sectionally.

Figure 7B:
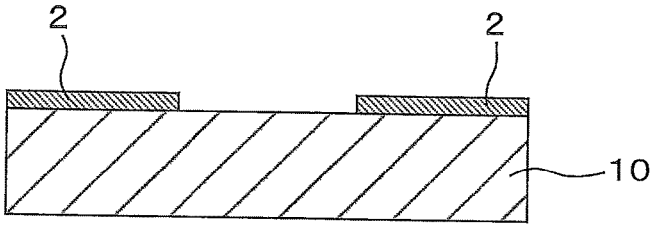

An Ag-based paste printed on a front surface of such a large-sized substrate 10 is dried and sintered. Thus, as shown in FIG. 6B and FIG. 7B, a plurality of pairs of front electrodes 2 which extend like belts at predetermined intervals are formed on the front surface of the large-sized substrate 10.

Figure 7C:
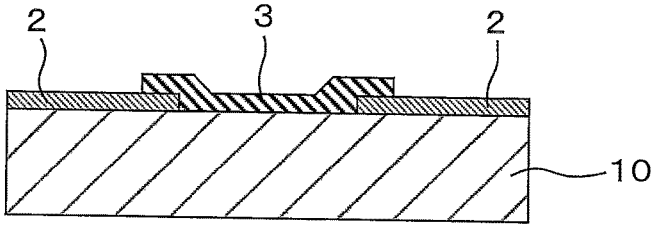

Next, a resistive element paste of ruthenium oxide or the like screen-printed on the front surface of the large-sized substrate 10 is dried and sintered. Thus, as shown in FIG. 6(C) and FIG. 7(C), each of resistive elements 3 is formed to be laid between, of the front electrodes 2, corresponding ones paired with each other. Incidentally, a sequence for forming the front electrodes 2 and the resistive elements 3 may be reverse to the aforementioned one.

Figure 7D:
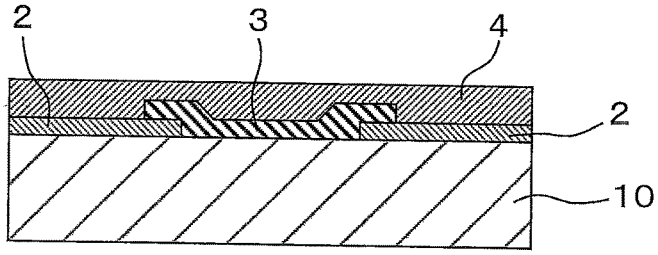

Next, as a material for reducing damage to the resistive elements 3 during formation of trimming grooves, a glass paste is screen-printed, dried and sintered. Thus, a not-shown undercoat layer is formed to cover the resistive elements 3. Then, the trimming grooves are formed in the resistive elements 3 from above the undercoat layer to thereby adjust resistance values of the resistive elements 3. Thereafter, an epoxy-based resin paste added with white pigment is screen-printed on the undercoat layer and thermally cured. Thus, as shown in FIG. 6(D) and FIG. 7(D), a semi-transparent protective layer 4 is formed to entirely cover the chip formation regions of the large-sized substrate 10 including the front electrodes 2 and the resistive elements 3.

Here, since the protective layer 4 covering the front electrodes 2 and the resistive elements 3 is made of a semi-transparent material, positions of the front electrodes 2 and the resistive elements 3 inside the protective layer 4 can be visually recognized through the protective layer 4. Thus, dicing positions (the primary division lines L1 and the secondary division lines L2) to be performed in a next step are determined, as shown in FIG. 6(E). Incidentally, each of the primary division lines L1 is a virtual line which passes through a corresponding one of widthwise central portions of the front electrodes 2 and extends in a lengthwise direction, and each of the secondary division lines L2 is a virtual line which passes through a gap between adjacent ones of the resistive elements 3 and extends in a perpendicular direction to the primary division lines L1. On this occasion, in order to confirm the positions of the front electrodes 2 and the resistive elements 3, the large-sized substrate 10 may be irradiated with backlight from behind so that the front electrodes 2 and the resistive elements 3 can be seen as if they emerge from the backlight. Therefore, the positions of the front electrodes 2 and the resistive elements 3 can be confirmed easily and accurately from above the protective layer 4.

When the primary division lines L1 and the secondary division lines L2 which are the dicing positions have been determined thus, the large-sized substrate 10 is cut along the primary division lines L1 and the secondary division lines L2 by a dicing blade, as shown in FIG. 6(F). Thus, individual chip elements 10A each of which is made to have substantially the same external shape as that of the chip resistor are obtained. Incidentally, a peripheral portion of the large-sized substrate 10 is a dummy region surrounding the respective chip formation regions. The dummy region is discarded after dicing and thrown away as substrates 10B. In addition, the primary division lines L1 and the secondary division lines L2 are virtual lines set on the large-sized substrate 10. As described above, neither primary division grooves nor secondary division grooves corresponding to the division lines are formed in the large-sized substrate 10.

Figure 7E:
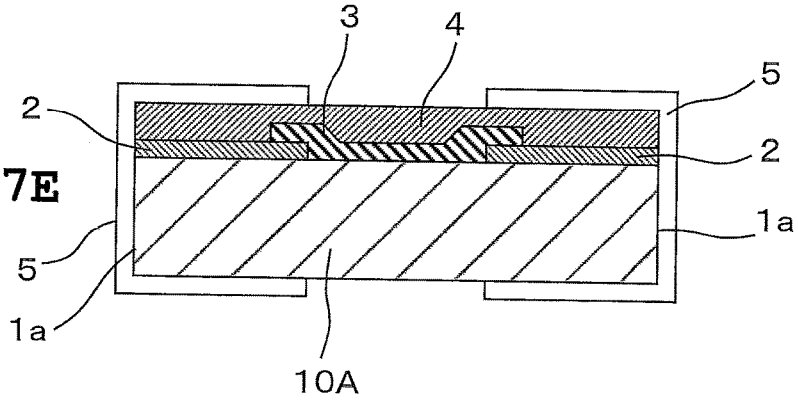

Next, an electrically conductive paste such as an Ag paste or a Cu paste is dip-coated on end surfaces of the chip elements 10A and thermally cured. Thus, cap-shaped end-surface electrodes 5 are formed to extend from lengthwise opposite end surfaces of the chip elements 10A and reach predetermined positions of widthwise opposite end surfaces of the chip elements 10A, as shown in FIG. 7(E). On this occasion, the external shape of each of the chip elements 10A is substantially a square cylinder. Accordingly, each of the end-surface electrodes 5 reaching the four surfaces of the chip element 10A have like the square cylinder shapes on the front surface of the protective layer 4 and the remaining three ceramics surfaces, and the rectangular parallelepiped shapes have the same dimensions as one another.

Figure 2:
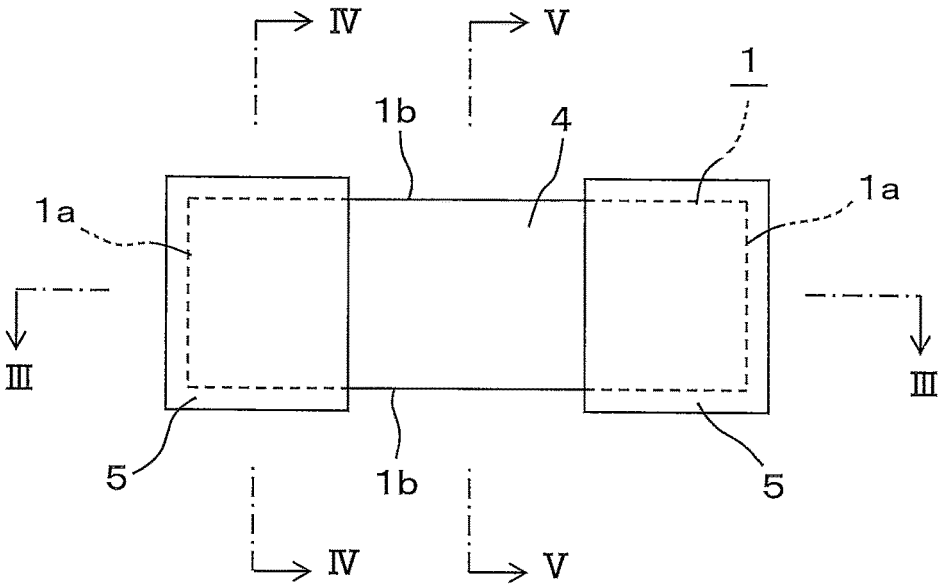
FIG. 2 A plan view of the chip resistor.

Finally, the individual chip elements 10A are electroplated with Ni, Si, or the like. Thus, not-shown external electrodes are formed to cover the end-surface electrodes 5. As a result, chip resistors as shown in FIG. 1 and FIG. 2 are completed.

In the chip resistor according to the embodiment, as described above, the front surface of the insulating substrate 1 made of the ceramics is entirely covered with the protective layer 4, and the protective layer 4 is made of the semi-transparent resin similar in color to the insulating substrate 1. Therefore, when the large-sized substrate 10 is diced and divided into the individual chip elements 10A, the positions of the front electrodes 2 and the resistive elements 3 inside the protective layer 4 are confirmed through the protective layer 4 so that the dicing positions can be determined accurately. Thus, dicing failure of cutting the resistive elements 3 by mistake can be prevented. In addition, the front electrodes 2 are entirely covered with the protective layer 4. Therefore, when the front electrodes 2 are cut along the division lines by dicing, burrs can be suppressed from occurring at the cut surfaces of the front electrodes 2.

In addition, in the chip resistor, the cap-shaped end-surface electrodes 5 are formed on the lengthwise opposite end portions of the insulating substrate 1. Accordingly, each of the end-surface electrodes 5 can be extended on the four surfaces including the exposed surface of the protective layer 4 and the remaining three surfaces so as to have the same dimensions on each of the four surfaces. Accordingly, the chip resistor can be mounted in the same way even if the chip resistor assumes any posture among the four surfaces. Stable bulk mounting with no directivity in terms of front, back, etc. can be performed. When an image is taken and processed as to whether the chip resistor has been accurately mounted on lands of a circuit board or not, the image is always taken in the same color regardless of the mounting posture of the chip resistor because one exposed surface of the protective layer 4 and the remaining three ceramics surfaces of the insulating substrate 1 are similar in color. Thus, the image can be processed easily and with high accuracy.

In addition, in the method for producing the chip resistor according to the embodiment, when the large-sized substrate 10 is diced along the primary division lines L1 and the secondary division lines L2 to thereby obtain the chip elements 10A, each of the front electrodes 2 formed like belts is cut in the lengthwise direction and the widthwise direction. Accordingly, the cut surfaces of the front electrodes 2 covered with the protective layer 4 are exposed from the end surfaces and the opposite side surfaces of each of the chip elements 10A. Accordingly, when the end-surface electrodes 5 are then formed on the opposite end portions of the chip element 10A, places where each of the front electrodes 2 and each of the end-surface electrodes 5 are connected are three surfaces including the corresponding end surface and the opposite side surfaces of the chip element 10A. Thus, connection reliability between the end-surface electrode 5 and the front electrode 2 can be increased greatly.

REFERENCE SIGNS LIST

1 insulating substrate
2 front electrode
3 resistive element
4 protective film
5 end-surface electrode
10 large-sized substrate
10A chip element
L1 primary division line
L2 secondary division line

The invention claimed is:

1. A method for producing a chip resistor, comprising the steps of:

forming a pair of front electrodes on each of chip formation regions in a front surface of a large-sized substrate made of ceramics;

forming resistive elements to be provided between and connected to the pair of front electrodes with each other respectively;

forming a protective layer on the whole of the chip formation regions in the front surface of the large-sized substrate to thereby cover the front electrodes and the resistive elements, the protective layer being made of a semi-transparent resin similar in color to the large-sized substrate;

confirming positions of the front electrodes and the resistive elements through the protective layer to thereby determine dicing positions, and then cutting the large-sized substrate along primary division lines and secondary division lines based on the dicing positions by a dicing blade to thereby form individual chip elements, the primary division lines passing through central portions of the front electrodes and extending in a lengthwise direction, the secondary division lines intersecting the primary division lines perpendicularly; and applying an electrically conductive paste to areas ranging from cut surfaces of the chip elements along the primary division lines to portions of cut surfaces of the chip elements along the secondary division lines to thereby form end-surface electrodes.

2. The method for producing a chip resistor according to claim 1, wherein: the large-sized substrate is irradiated with backlight from behind when the positions of the front electrodes and the resistive elements are confirmed through the protective layer.

* * * * *